United States Patent [19]

Hatakeyama et al.

[11] Patent Number: 4,580,702

[45] Date of Patent: Apr. 8, 1986

[54] TUBULAR CONTAINER

[75] Inventors: Yoshiharu Hatakeyama, Tokyo; Kenzo Teshima, Chiba; Shuji Nakazawa, Ashikaga, all of Japan

[73] Assignee: Yoshida Industry Co., Ltd., Tokyo, Japan

[21] Appl. No.: 605,391

[22] Filed: Apr. 30, 1984

[30] Foreign Application Priority Data

May 2, 1983 [JP] Japan ..... 58-65117[U]

[51] Int. Cl.[4] ..... B65D 37/00

[52] U.S. Cl. ..... 222/215; 222/107

[58] Field of Search ..... 150/55; 206/277; 222/107, 206, 215, 562, 575; D9/302

[56] References Cited

U.S. PATENT DOCUMENTS

| | | | |
|---|---|---|---|
| 2,401,784 | 6/1946 | Zahara | 222/107 |
| 2,500,639 | 3/1950 | Lermer | 222/215 |
| 2,682,355 | 6/1954 | Robbins | 222/107 |
| 3,411,674 | 11/1968 | Gould | 222/215 |
| 3,595,441 | 7/1971 | Grosjean | 222/107 |
| 4,261,682 | 4/1981 | Yamada et al. | 222/215 |
| 4,470,521 | 9/1984 | Scammell | 222/107 |

FOREIGN PATENT DOCUMENTS

| | | | |
|---|---|---|---|
| 197262 | 4/1958 | Austria | 222/107 |

*Primary Examiner*—Joseph J. Rolla
*Assistant Examiner*—Michael S. Huppert
*Attorney, Agent, or Firm*—Wenderoth, Lind & Ponack

[57] ABSTRACT

A tubular container comprises a hollow body opened at one end and having in cross section a polygonal shape with sharp ridges being formed at corners, and a headpiece including a neck and a shoulder which includes an inclined portion having ridges and a polygonal configuration corresponding to the hollow body, the headpiece and the hollow body being integrally fused with each other with the ridges of the inclined portion being in agreement with the sharp ridges of the hollow body.

2 Claims, 2 Drawing Figures

TUBULAR CONTAINER

BACKGROUND OF THE INVENTION

The present invention relates to a tubular container formed of synthetic resin material and more particularly to a tubular container in which a headpiece comprising a neck and a shoulder is integrally bonded to an upper end of a hollow sleeve or body.

A tubular container of this kind is used to receive various materials such as toothpaste, cosmetics, etc. and is particularly suitable for paste material. The material is received in the elliptical body and is extruded or squeezed from an outlet formed through the neck when a pressure is applied to the body by a user. In order to enable the user to squeeze the body with small force, it is desirable that the body is formed of soft plastic with a thin wall. However, the elliptical body thus formed has only a small elasticity and, therefore, the elastic stability of the body is reduced, whereby the body tends to remain deformed after the pressure applied thereto is removed. This is not desirable because it spoils the external appearance of the container, particularly when the amount of material remaining in the body is decreased.

Accordingly, an object of the present invention is to provide a tubular container in which the elastic stability of a hollow body may be increased, thereby making it possible for the body to recover its original, and therefore desirable, shape after a pressure applied thereto is removed.

Another object of the present invention is the provision of a tubular container which will permit a user to discharge material contained therein with small squeezing force, but which will not permit the body to remain deformed even after a major portion of the material is dispensed.

SUMMARY OF THE INVENTION

According to the present invention, there is provided a tubular container which comprises a hollow body and a headpiece. The hollow body is formed by extrusion molding of synthetic resin material and is open at one end thereof. The hollow body has a polygonal shape in transverse cross section with sharp ridges being formed at corners. The headpiece is formed by injection molding of synthetic resin material and includes a neck and a shoulder. The neck has an outlet formed therein. The shoulder includes an inclined portion having a polygonal configuration corresponding to the shape of the one end of the hollow body, the inclined portion being formed with ridges. The headpiece is integrally fused at the shoulder with the hollow body with the ridges of the inclined portion being in alignment with the sharp ridges of the hollow body.

Preferably, the hollow body has at least six sides.

More preferably, the shoulder further includes a flat circular portion inside the inclined portion, and the inclined portion is formed by gradually reducing the thickness of the shoulder toward an outer end thereof.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
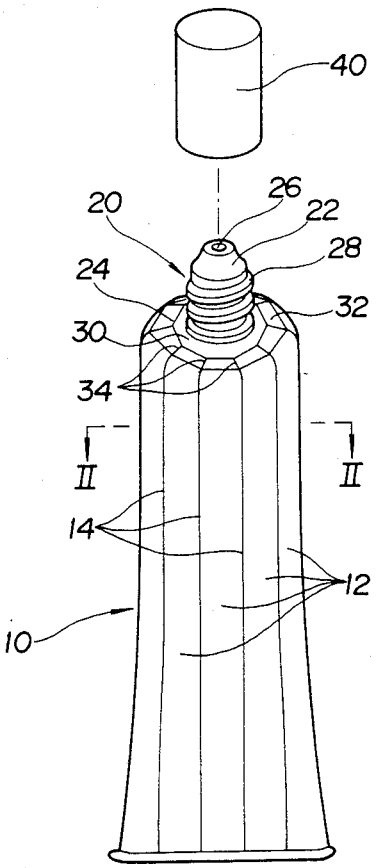
FIG. 1 is a perspective view illustrating a tubular container according to a preferred embodiment of the present invention.
Figure 2:
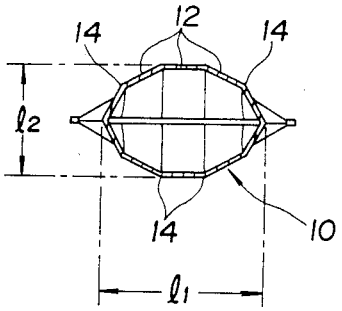
FIG. 2 is a cross sectional view taken along line II—II in FIG. 1.

Referring now to the drawings, there is shown a tubular container according to a preferred embodiment of the present invention. This tubular container generally comprises a hollow body 10 and a headpiece 20 mounted on the upper end of the body 10. The body 10 is made of thermoplastic resin material such as polyethylene and is formed by means of extrusion molding. A die used in the extrusion molding of the body 10 has a polygonal opening or outlet defined between an inner mandrel and an outer core and, therefore, the molded hollow body 10 has in its cross section a polygonal configuration corresponding to the shape of the opening of the die. The body 10 is circumferentially divided into a plurality of rectangular sides or portions 12 each of which is defined by adjacent sharp ridges 14 extending longitudinally from the upper end of the body 10 to the lower end thereof. The configuration of the body 10 is determined by the number of the ridges 14, which number is preferably more than six so that the body 10 has at least six rectangular portions 12. As shown in FIG. 2, the respective rectangular portions 12 may have substantially the same width, that is, the ridges 14 may be formed at substantially the equal intervals, with each pair of sides 12 extending at an obtuse angle with respect to each other and defining a junction. The body 10 is somewhat flattened, and preferably the thickness $l_2$ of the body 10 is formed to 60 to 70% of the width $l_1$ thereof at the level of line II—II in FIG. 1, this ratio varying when measured at other levels.

The headpiece 20 comprises a neck 22 and a shoulder 24. The neck 22 is provided with an outlet 26 through which a material to be contained in the body 10 will be extruded. A thread 28 is formed around the outer surface of the neck 22 for threaded engagement with a cap 40. The shoulder 24 includes an inner flat annular portion 30 and an outer inclined portion 32 which has at its outer edge a configuration corresponding to that of the body 10 at the upper end thereof. The inclined portion 32 is formed to have a thickness gradually reduced toward the outer edge thereof and comprises a plurality of sections each defined by adjacent ridges 34. The headpiece 20 is integrally molded by injection molding and bonded to the body 10. When assembling the body 10 and the headpiece 20, the rectangular portions 12 are positioned to match with the corresponding sections of the inclined portion 32 so that the ridges 14 of the body 10 are aligned with the ridges 34 of the headpiece 20 with an angle slightly larger than 90 degrees at the junctions. The assembly of the body 10 and the headpiece 20 may be made by inserting the body 10 into a cavity of an injection molding die and injecting thermoplastic resin material into the cavity to form the headpiece 20 which is simultaneously fused with the body 10.

After the body 10 and the headpiece 20 are assembled, the cap 40 is threadedly engaged with the neck 22 for closing the outlet 26. The lower end 16 of the body 10 is sealed by an application of heat and pressure and is flattened as shown in the drawings, after a desired material is introduced in the body 10 from the lower end.

The ridges 14 longitudinally extending on the body 10 tend to maintain their normal, substantially straight status. When the body 10 is pressed to extrude the material therein, a force is generated at the ridges 14 to expand the body 10 thereby to recover the ridges 14 to their straight status. Therefore, as soon as the pressure applied to the body 10 is removed, the body 10 expands until it recovers its original shape, by such a force and by the elasticity of the plastic material forming the body 10. In other words, the ridges 14 increase the elastic stability of the body 10. This makes it possible to reduce the thickness of the body 10 and to form the body 10 of soft synthetic resin material, without causing a problem that after the pressure is removed the body 10 remains deformed as experienced in the conventional tube. Thus, the present tubular container will maintain its original, therefore desirable, shape until the material contained therein is used up. Softness and small thickness of the body 10 are advantageous of the material since they enable a user to extrude the material with less force.

Furthermore, as the shoulder 24 has at the inclined portion 32 the polygonal configuration corresponding to that of the upper end of the body 10 and as the ridges 34 are aligned with the ridges 14 of the body 10, the polygonal shape of the body 10 is securely maintained for ensuring the elastic stability of the body 10. The aligned ridges 14 and 34 provide a smooth joint of the body 10 to the headpiece 20, and the entire configuration of the tubular container is new and impressive.

In the illustrated embodiment, the body 10 is provided with ten ridges 14 which divide the tube 10 into the same number of rectangular portions 12. However, the polygonal shape is not limited to this embodiment and any desired number of the ridges may be formed. Preferably, the number of the ridges 14 is more than six so that the body 10 has at least six sides. This ensures the increased elastic stability of the body 10 and serves to avoid extreme differences in the shapes of the tube at the upper part and at the sealed lower end thereof.

Although the present invention has been described with reference to the preferred embodiments thereof, many modifications and alterations may be made within the spirit of the present invention.

What is claimed is:

1. A tubular container comprising:

a hollow body formed by extrusion molding of synthetic resin material, said hollow body being opened at one end and having a polygonal transverse cross-sectional shape defined by at least six sides of substantially equal widths, each said side being joined to adjacent said sides at junctions to form sharp ridges, and each pair of said adjacent sides extending at an obtuse angle with respect to each other at each said junction; and a head piece formed by injection molding of synthetic resin material, said headpiece including a neck and a shoulder, said neck having formed therein an outlet, said shoulder including an inclined portion having a polygonal configuration corresponding to the shape of said one end of said hollow body, said inclined portion being formed with ridges, and said headpiece being integrally fused at said shoulder with said hollow body with said ridges of said inclined portion being in alignment with said sharp ridges of said hollow body.

2. A tubular container as claimed in claim 1, wherein said shoulder further includes a flat circular portion inwardly of said inclined portion, said inclined portion being formed by gradually reducing the thickness of said shoulder toward an outer end thereof.

* * * * *